US005636977A

United States Patent [19]

Benson et al.

[11] Patent Number: 5,636,977

[45] Date of Patent: *Jun. 10, 1997

[54] BURNER APPARATUS FOR REDUCING NITROGEN OXIDES

[75] Inventors: Charles E. Benson, Windham, N.H.; Peter J. Loftus, Somerville, Mass.; Robert Cole; William A. Wiener, both of Parsons, Kans.

[73] Assignee: Gas Research Institute, Chicago, Ill.

[ * ] Notice: The term of this patent shall not extend beyond the expiration date of Pat. No. 5,573,391.

[21] Appl. No.: 322,755

[22] Filed: Oct. 13, 1994

[51] Int. Cl.[6] ..... F23C 5/00

[52] U.S. Cl. ..... 431/8; 431/9; 431/115; 431/181

[58] Field of Search ..... 431/8, 9, 10, 12, 431/115, 116, 181, 174, 187, 351, 354

[56] References Cited

U.S. PATENT DOCUMENTS

| | | | |
|---|---|---|---|
| 3,838,652 | 10/1974 | Schol . | |
| 3,920,377 | 11/1975 | Yanuki et al. | 431/115 |
| 4,230,445 | 10/1980 | Janssen . | |
| 4,575,332 | 3/1986 | Oppenberg et al. . | |
| 4,995,807 | 2/1991 | Rampley et al. . | |
| 5,013,236 | 5/1991 | Khinkis . | |
| 5,044,932 | 9/1991 | Martin et al. . | |
| 5,073,105 | 12/1991 | Martin et al. . | |
| 5,098,282 | 3/1992 | Schwartz et al. . | |
| 5,129,818 | 7/1992 | Balsiger . | |
| 5,158,445 | 10/1992 | Khinkis . | |
| 5,195,884 | 3/1993 | Schwartz et al. | 431/8 |
| 5,209,187 | 5/1993 | Khinkis . | |
| 5,275,554 | 1/1994 | Faulkner . | |
| 5,350,293 | 9/1994 | Khinkis et al. . | |
| 5,403,181 | 4/1995 | Tanaka et al. | 431/9 |
| 5,407,347 | 4/1995 | Bortz | 431/354 |
| 5,573,391 | 11/1996 | Benson et al. | 431/8 |

*Primary Examiner*—James C. Yeung
*Attorney, Agent, or Firm*—Speckman, Pauley & Fejer

[57] ABSTRACT

A burner apparatus and method for reducing nitrogen oxides that are formed during combustion of gaseous fuel. Primary gaseous fuel and excess oxidant are premixed to form a fuel/oxidant mixture which is introduced into and combusted within a primary combustion zone. Primary combustion products are introduced into a secondary combustion zone. Secondary gaseous fuel is also introduced into the secondary combustion zone and is preferably mixed with the primary combustion products. The mixture of secondary gaseous fuel and primary combustion products is combusted in a secondary combustion zone. A portion of the secondary combustion products are internally recirculated into the secondary combustion zone. The overall combustion products can be externally recirculated and introduced into the primary combustion zone. A portion of the fuel/oxidant mixture, with or without the recirculated overall combustion products, can be bypassed around the primary combustion zone and introduced into the secondary combustion zone.

14 Claims, 5 Drawing Sheets

BURNER APPARATUS FOR REDUCING NITROGEN OXIDES

BACKGROUND OF THE INVENTION

1. Field of the Invention

This invention relates to a burner apparatus and method for reducing nitrogen oxides, formed during combustion of gaseous fuel, by operating with a fuel-lean primary combustion chamber, staged fuel injection and internal flue gas recirculation within a secondary combustion zone, external flue gas recirculation from downstream of the secondary combustion zone back to the primary combustion zone, and/or bypass of a portion of primary gaseous fuel and excess oxidant from the primary combustion zone to the secondary combustion zone.

2. Description of Prior Art

Many conventional gas-fired burners use a diffusion flame combustion process in which combustion occurs over a range of equivalence ratios, including high temperature, lean regions where thermal nitrogen oxides ($NO_x$) form. One known method for reducing peak flame temperatures is to use a combustion process which creates a fuel-rich primary combustion zone and subsequent air staging with corresponding heat loss, resulting in lowering the overall combustion equivalence ratio to achieve complete combustion.

Another known method for reducing peak flame temperatures relates to a combustion process that operates with a fuel-lean primary combustion zone and fuel staging in order to raise the equivalence ratio. However, such known methods of staged fuel combustion rely upon a diffusion flame to produce the lean primary stage. External flue gas recirculation has been added to such known methods for further reducing $NO_x$.

In the combustion of gaseous fuels, $NO_x$ is formed primarily through fixation of molecular nitrogen and oxygen in the combustion air. It is known that thermal $NO_x$ formation depends on the existence of flame regions with relatively high temperatures and excess oxygen. Many conventional combustion methods for reducing $NO_x$ are based upon avoiding such conditions.

It is necessary to consider the prompt $NO_x$ formation process in order to reach very low $NO_x$ levels. Reactions between hydrocarbon fragments and molecular nitrogen can lead to the formation of bound nitrogen species, such as hydrogen cyanide (HCN), which can subsequently be oxidized to nitrogen monoxide (NO). Such process becomes significant relative to the thermal mechanism under moderately fuel-rich conditions at relatively lower temperatures. Avoiding such conditions can reduce prompt $NO_x$ contributions.

Faulkner, U.S. Pat. No. 5,275,554 discloses a combustion system for reducing $NO_x$ emissions by recirculating flue gas and a secondary fuel into a combustion chamber of a heat exchanger, adjacent an outlet end of a burner. A low $NO_x$ manifold housing is rigidly coupled between the heat exchanger and a conventional gas and oil burner. The '554 patent apparently teaches stoichiometric combustion within the burner.

Martin et al., U.S. Pat. No. 5,044,932 teaches a process and apparatus for reducing $NO_x$ content of flue gas effluent by internally recirculating flue gas into a primary combustion zone. Fluid driven eductors are used to enhance the amounts of collected internally recirculated flue gas into the primary combustion zone.

Schol, U.S. Pat. No. 3,838,652 discloses a burner apparatus which is used to recycle flue gas through openings arranged circumferentially in a duct member. The flue gas flowing through the openings and through a flame hole into a primary combustion chamber forms a cooling mantle of flue gas enveloping the flame of the burning fuel emanating from the burner.

There is an apparent need for a burner apparatus and method which operate with staged fuel combustion wherein a primary combustion zone operates under fuel-lean conditions and at a relatively low temperature, and in which both stages operate with overall fuel-lean stoichiometry.

SUMMARY OF THE INVENTION

It is one object of this invention to provide a burner apparatus and method for reducing nitrogen oxides wherein a primary combustion zone operates under excess air conditions and a secondary combustion zone operates with internal flue gas recirculation.

It is another object of this invention to provide a burner apparatus and method which bypass a portion of a fuel/air mixture from a primary combustion zone to a secondary combustion zone.

It is another object of this invention to provide a burner apparatus and method which allows external flue gas recirculation of overall combustion products back to the primary combustion zone.

The above and other objects of this invention are accomplished with a burner apparatus and method for reducing nitrogen oxides ($NO_x$), which are formed during combustion of gaseous fuel, wherein primary gaseous fuel and excess air are combined to form a fuel/air mixture that is fuel-lean. The fuel/air mixture is introduced into a primary combustion zone and combusted to form primary combustion products. The primary combustion products are introduced into a secondary combustion zone, along with secondary gaseous fuel, which is combusted and forms secondary combustion products.

A portion of the secondary combustion products are internally recirculated and introduced into the secondary combustion zone. In one preferred embodiment according to this invention, at least a portion of the secondary combustion products are recirculated back to the primary combustion zone. At a least a portion of fuel/air mixture can be bypassed around the primary combustion zone and introduced directly into the secondary combustion zone.

In one preferred embodiment according to this invention, the excess air is introduced within a blower housing. If employed, the external flue gas recirculation can be achieved by returning a portion of the overall combustion products to an inlet in communication with the blower housing or to an inlet of a blower.

The burner apparatus of this invention is designed to form a central primary flame envelope wherein primary combustion occurs, which is peripherally surrounded by a secondary flame envelope wherein secondary combustion occurs. A plurality of staged gas ports are used to inject the secondary gaseous fuel and recirculated secondary combustion products, so that the secondary flame envelope surrounds the primary flame envelope.

DESCRIPTION OF PREFERRED EMBODIMENTS

Figure 1:
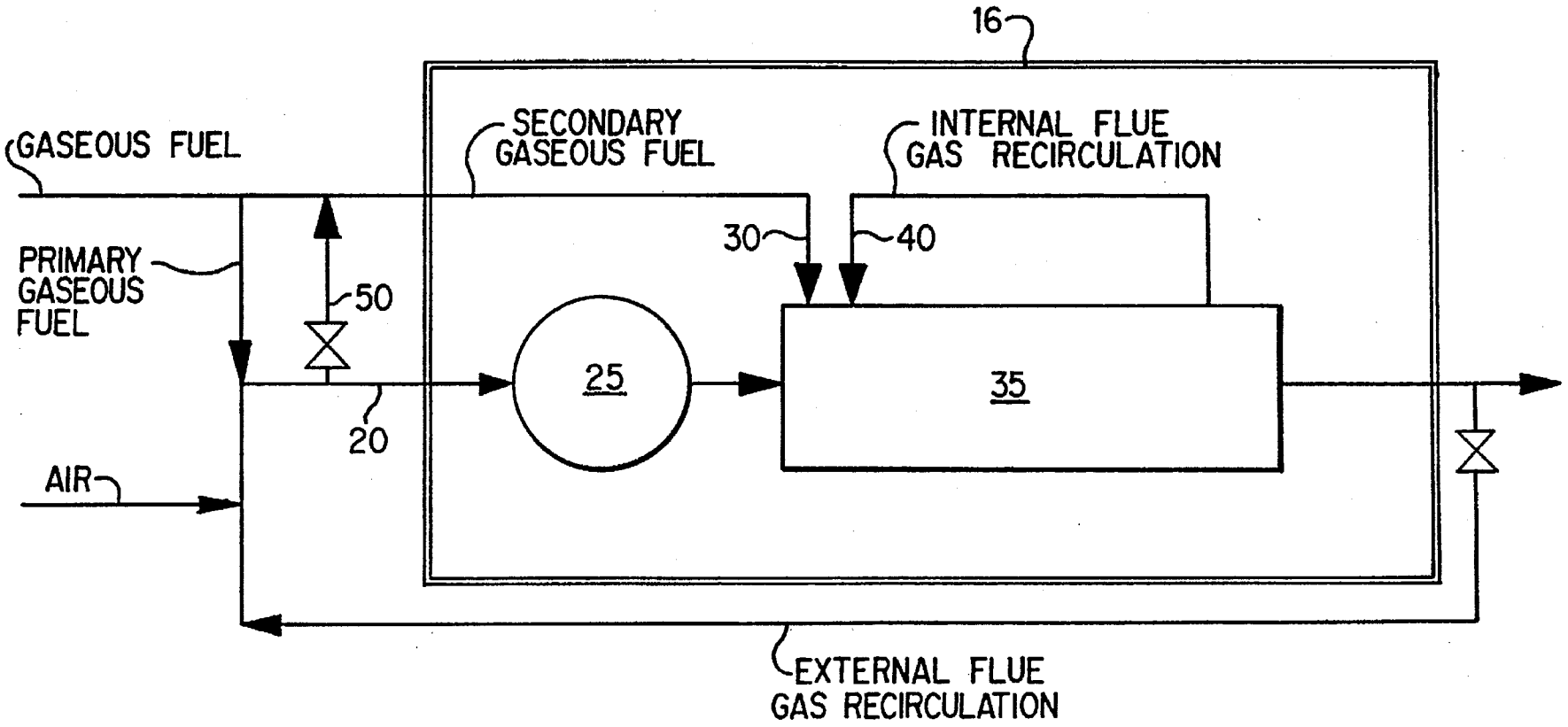
FIG. 1 is a schematic flow diagram showing a two-staged combustion method with staged fuel injection, according to one preferred embodiment of this invention.

Referring to the flow diagram of FIG. 1, a method for reducing nitrogen oxides ($NO_x$) resulting from gaseous fuel combustion, according to one preferred embodiment of this invention, begins with forming or premixing gaseous fuel and excess air to form a fuel-lean mixture. Such fuel/air mixture is introduced into primary combustion zone 25 and then combusted thereby forming primary combustion products. The primary combustion products are introduced into secondary combustion zone 35. As shown in FIG. 1, both primary combustion zone 25 and secondary combustion zone 35 are located within combustion chamber 16.

As used throughout this specification and in the claims, the term "air" is intended to be interchangeable with the term "oxidant." It is apparent that atmospheric air, oxygen, oxygen-enriched air, another suitable oxidant, or any combination thereof can be used to form a combustible mixture with a gaseous fuel, such as natural gas, propane, refinery fuel gas and the like. Also as used throughout the specification and in the claims, the phrase "gaseous fuel" is intended to include fuels in a gaseous state or any other suitable light liquid hydrocarbon fuel that can be stored as a liquid and then vaporized prior to combustion. Propane is an example of a light liquid hydrocarbon fuel that can be stored as a liquid and then vaporized to form the equivalent of a gaseous fuel, within the context of the specification and the claims.

Secondary gaseous fuel, which can be the same or a different type of fuel as the primary gaseous fuel, is introduced into the secondary combustion zone to form a mixture with the primary combustion products. The secondary gaseous fuel and the primary combustion products are preferably mixed and then combusted within secondary combustion zone 35 thereby forming secondary combustion products. A portion of the secondary combustion products is internally recirculated and introduced back into the secondary combustion zone, schematically shown in FIG. 1 as occurring completely within combustion chamber 16.

Figure 2:
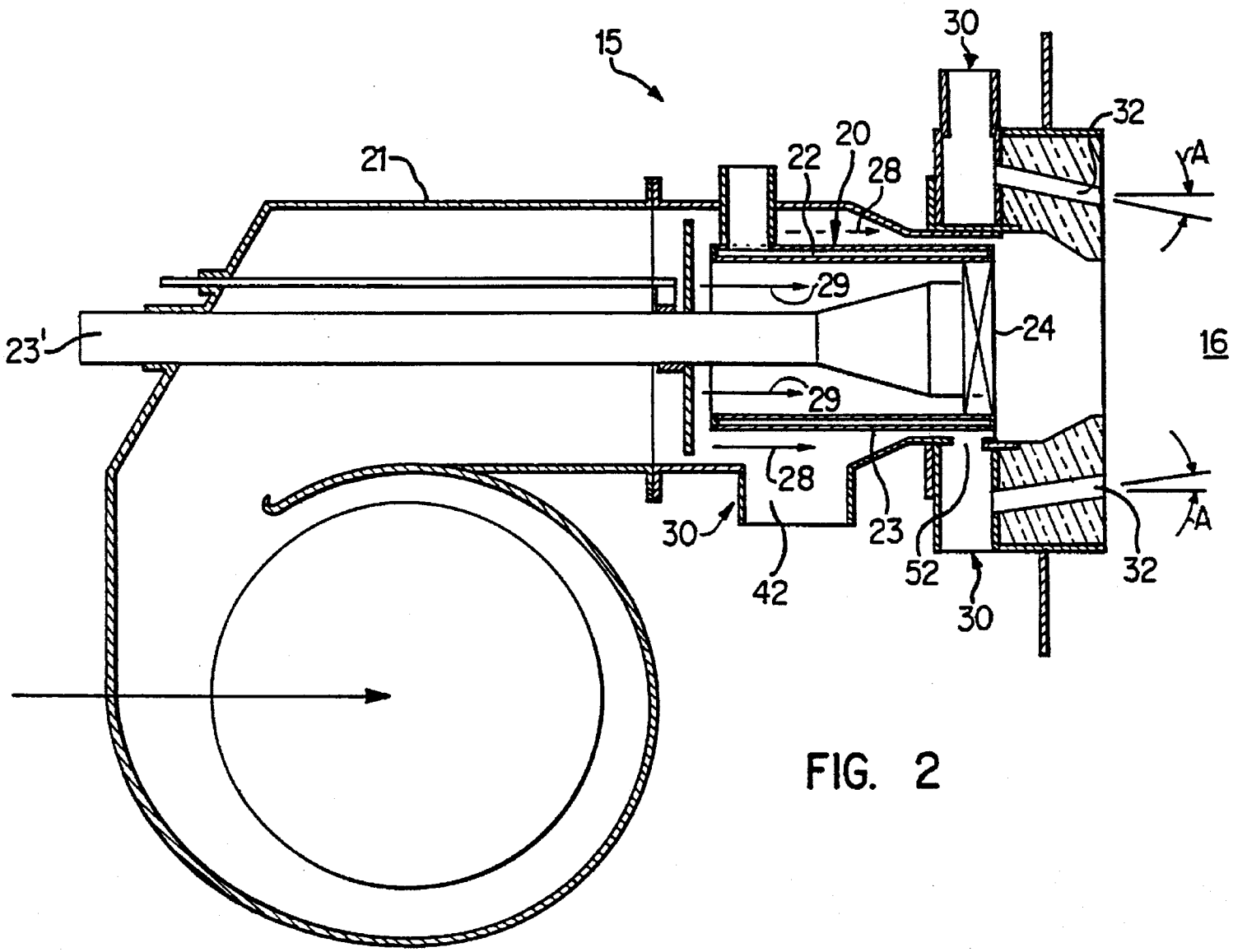
FIG. 2 shows a diagrammatic partial cross-sectional view of a burner apparatus, according to one preferred embodiment of this invention.

In one preferred embodiment according to this invention as shown in FIGS. 1 and 2, primary feed means 20 introduce the primary gaseous fuel and excess air within primary combustion zone 25 to form a primary flame envelope within combustion chamber 16. Secondary feed means 30 introduce the secondary gaseous fuel into secondary combustion zone 35 to form a secondary flame envelope which peripherally surrounds the primary flame envelope defined by primary combustion zone 25.

Both the high level of excess air in primary combustion zone 25 and the introduction of recirculated flue gas, also referred to as the overall combustion products, serve to significantly lower flame temperatures and thus control thermal $NO_x$ formation in primary combustion zone 25. The fuel lean conditions within primary combustion zone 25 also suppress the prompt $NO_x$ formation mechanism.

In one preferred embodiment according to this invention, at least a portion of the overall combustion products are recirculated to primary combustion zone 25. The primary gaseous fuel is preferably premixed with the excess combustion air and the overall combustion products, preferably in an amount of approximately 0 to approximately 50% of the total mass flow of the overall combustion products. Such premixture produces fuel-lean combustion within primary combustion zone 25, preferably with a fuel equivalence ratio within a range of approximately 0.5 to approximately 0.75.

The secondary gaseous fuel is injected into the secondary flame envelope, downstream of primary combustion zone 25. The secondary gaseous fuel and the primary combustion products are preferably mixed in amounts to form an overall fuel equivalence ratio of approximately 0.75 to approximately 0.95. Such overall equivalence ratio results in high thermal efficiencies in conventional combustion apparatuses. By allowing for sufficient heat loss from primary combustion zone 25, as well as for entrainment of secondary combustion products into secondary combustion zone 35, the temperature of the second stage of combustion is controlled to a point where thermal $NO_x$ formation is reduced significantly.

In another preferred embodiment according this invention, at least a portion of the fuel/air mixture, which may or may not include recirculated overall combustion products, is bypassed around primary combustion zone 25 and introduced into secondary combustion zone 35, as schematically shown in FIG. 1. Such bypass arrangement allows secondary oxidation reactions to proceed more rapidly, but initially under fuel-rich conditions which results in relatively low $NO_x$ rates. The bypass arrangement also produces a more compact secondary flame envelope. Introducing or entraining secondary combustion products into secondary combustion zone 35 also lowers flame temperatures and thus reduces $NO_x$ formation when the second stage of combustion transitions to lean conditions. With the additional mass flow created by the bypass arrangement, the momentum of secondary jets introduced within secondary combustion zone 35 improves controls of the second stage mixing process.

Although the recirculation of overall combustion products back to primary combustion zone 25 is not necessary according to the method of this invention, such external flue gas recirculation significantly enhances the reduction of $NO_x$. For example, a method according to this invention using burner apparatus 15 according to this invention was operated only using the staged introduction of gaseous fuel without recirculation of overall combustion products to primary combustion zone 25, and achieved 15 to 20 ppm $NO_x$ (dry, corrected to 3% $O_2$). When the overall combustion products were recirculated to primary combustion zone 25, using the same method and burner apparatus 15, the $NO_x$ levels were reduced to 9 to 10 ppm (dry, corrected to 3% $O_2$). Although the method of this invention without recirculation of overall combustion products to primary combustion zone 25 results in relatively higher levels of $NO_x$ emissions than with such recirculation, associated equipment costs are lower without such recirculation.

According to one preferred embodiment of this invention, burner apparatus 15 comprises: primary feed means 20 for mixing primary gaseous fuel with excess air and introducing the resulting fuel/air mixture into primary combustion zone 25; secondary feed means 30 for introducing secondary gaseous fuel into secondary combustion zone 35 which is downstream with respect to primary combustion zone 25; and recirculation means 40 for internally recirculating a portion of the secondary combustion products into secondary combustion zone 35. As shown in FIG. 2, primary feed means 20 comprise a suitably shaped blower housing 21. In one preferred embodiment according to this invention, gas manifold 23 is mounted within blower housing 21, such that annular space 22 is formed about a periphery of gas manifold 23. In another preferred embodiment according to this invention, gas manifold 23' can be used in lieu of or together with gas manifold 23.

Mixing means 24 are preferably mounted at a discharge section of gas manifold 23 or 23'. Mixing means 24 may comprise a swirler, a bluff body, a diffuser, or any other suitable mixing device known to those skilled in the art.

Figure 3:
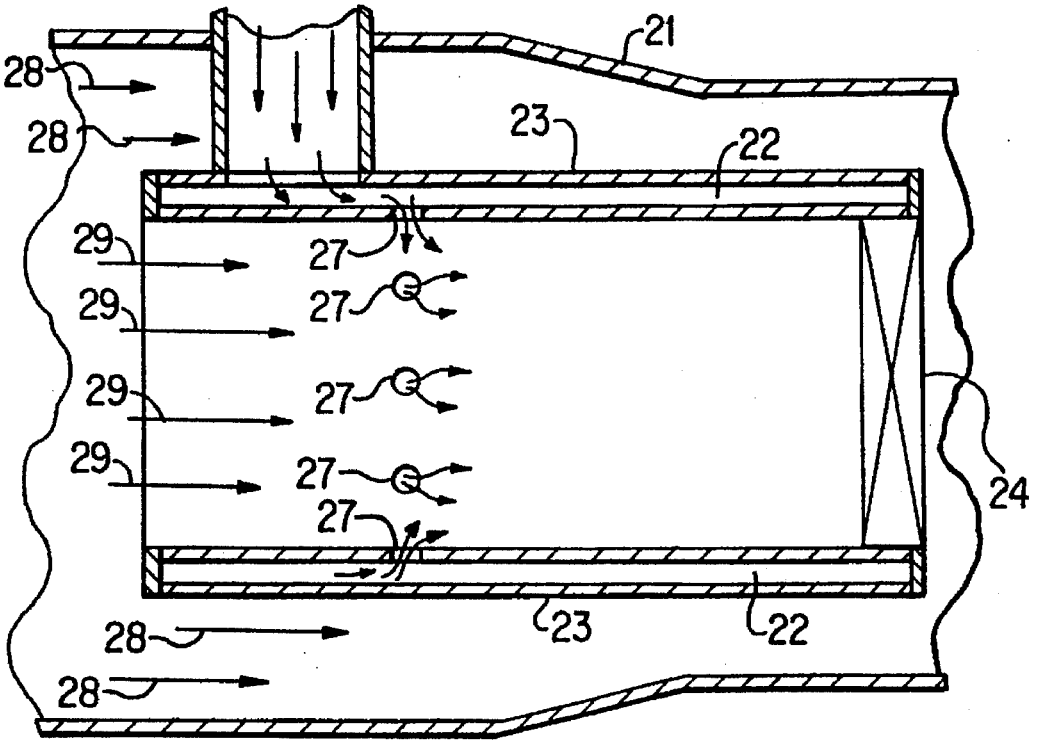
FIGS. 3–7 show partial cross-sectional views of different preferred embodiments for introducing and mixing primary gaseous fuel into the flow of combustion air.
Figure 4:
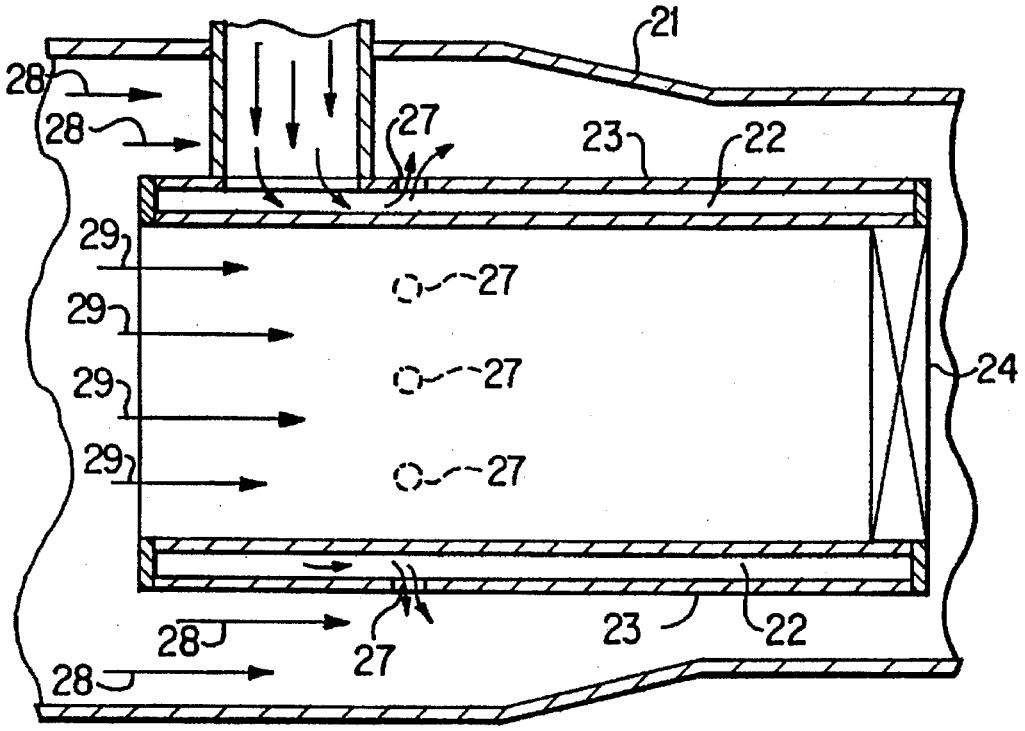
Figure 5:
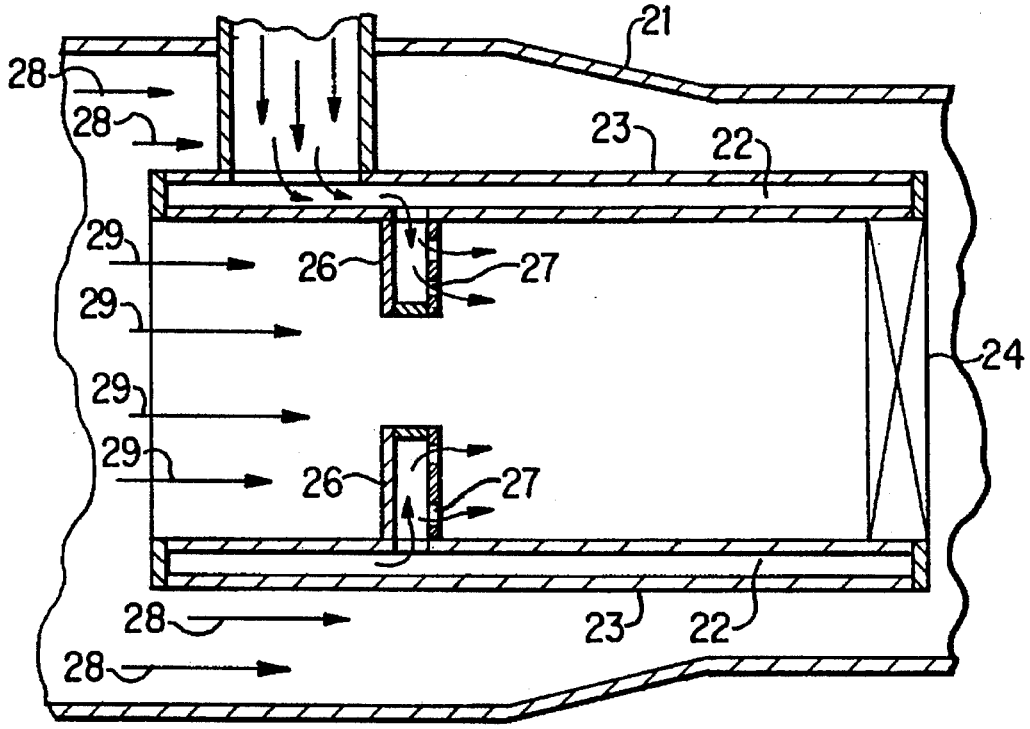
Figure 6:
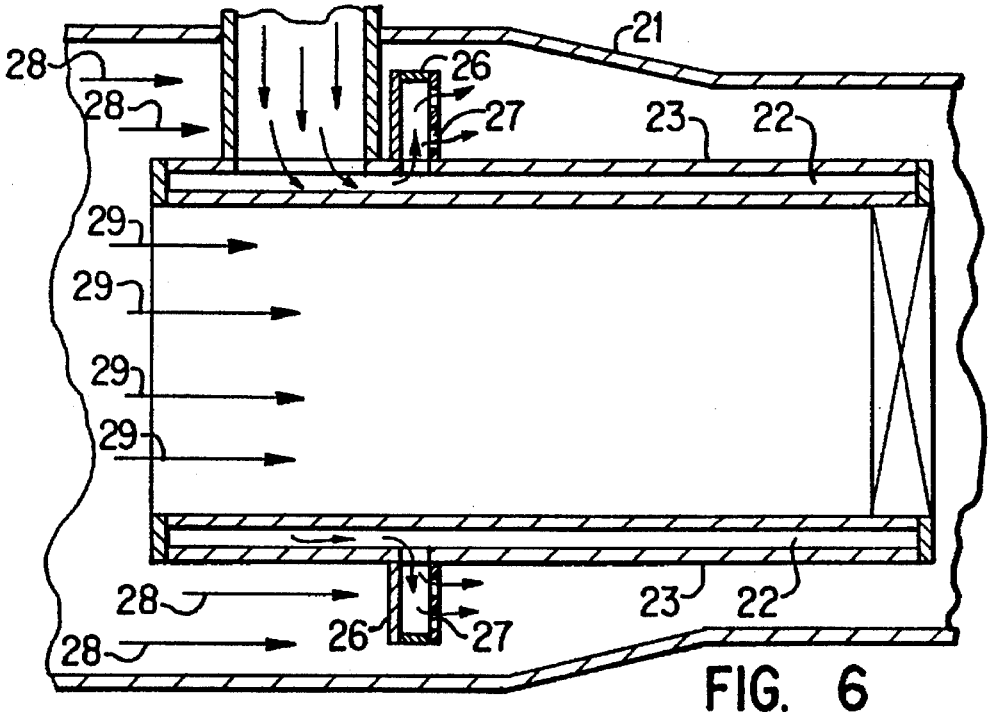
Figure 7:
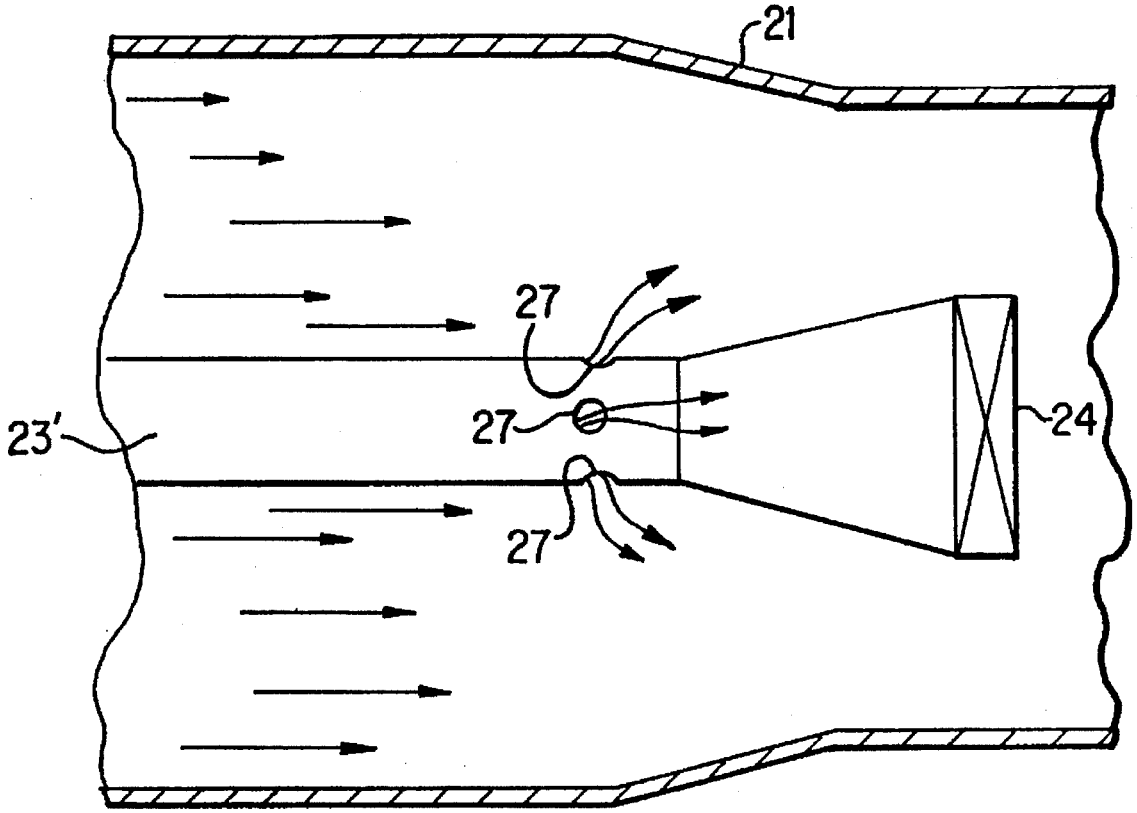

FIGS. 3–7 show various sizes, shapes and positions of ports 27 which can be used to inject the primary gaseous fuel into a stream of combustion air or other suitable oxidant that carries the primary gaseous fuel into primary combustion zone 25. FIG. 3 shows radial ports 27 which inject the primary gaseous fuel radially inward into oxidant 29 flowing within gas manifold 23. FIG. 4 shows radial ports 27 which inject the primary gaseous fuel outwardly into oxidant 28 flowing in an annular space formed between blower housing 21 and gas manifold 23. FIG. 5 shows a plurality of closed-end tubes 26 having one or more ports 27 which inject the primary gaseous fuel in a spoked arrangement into oxidant 29 flowing within gas manifold 23. FIG. 6 shows a plurality of closed-end tubes 26 each having one or more ports 27 that inject the primary gaseous fuel into oxidant 28, also in a spoked arrangement. FIG. 7 shows the primary gaseous fuel flowing through ports 27 in gas manifold 23' which inject the primary gaseous fuel radially away from gas manifold 23'.

FIGS. 3–7 show five different preferred embodiments for the arrangement of ports 27. Each arrangement preferably comprises between approximately 4 and approximately 32 ports 27 which are preferably equally spaced about the periphery of gas manifold 23 or 23'. It is apparent that the different embodiments can be operated individually or in any suitable combination.

As shown in FIG. 2, secondary feed means 30 comprise injection means for forming fluid jets directed toward secondary combustion zone 35. The injection means may comprise a plurality of staged gas ports 32, preferably 4 to 16, positioned about annular space 22. Each staged gas port 32 is preferably positioned to form the secondary flame envelope so that it peripherally surrounds the primary flame envelope. Each staged gas port 32 is aimed radially inward toward the primary flame envelope, preferably at an injection angle A of approximately 0° to approximately 30°. FIG. 3 shows staged gas port 32 positioned at injection angle A within such approximate range. Each staged gas port 32 forms at least one orifice 33, preferably 1 to 3 orifices 33, each of which are in communication with combustion chamber 16. FIG. 2 shows each staged gas port 32 having a discharge nozzle section with 2 orifices 33. It is apparent that staged gas ports 32 can have any suitable cross section which is conducive to forming a suitable secondary flame envelope. It is also apparent that each staged gas port 32 can be formed by an inlet tube which is directed radially inward toward primary combustion zone 25 or the primary flame envelope.

According to one preferred embodiment of this invention, bypass means 50 comprise blower housing 21 having opening 52, as shown in FIG. 2, which forms communication with both primary feed means 20 and secondary feed means 30. It is apparent that bypass means 50 is not necessary for operation of burner apparatus 15 according to this invention, but is preferred. It is also apparent that bypass means 50 may comprise any other suitable conduit, bore or opening that forms communication between primary feed means 20 and secondary feed means 30.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A burner apparatus comprising:

primary feed means for mixing primary gaseous fuel with excess oxidant and introducing a fuel/oxidant mixture into a primary combustion zone;

secondary feed means for introducing secondary gaseous fuel into a secondary combustion zone downstream with respect to said primary combustion zone;

recirculation means for internally recirculating into said secondary combustion zone a portion of secondary combustion products; and bypass means for bypassing at least a portion of said fuel/oxidant mixture and flue gas recirculated from said secondary combustion zone to said secondary feed means.

2. A burner apparatus according to claim 1 wherein said primary feed means comprise a blower housing, a gas manifold mounted within said blower housing, said blower housing having an annular space surrounding said gas manifold, and inlet means for introducing air into said annular space.

3. A burner apparatus according to claim 2 wherein mixing means are mounted at a discharge section of said gas manifold.

4. A burner apparatus according to claim 2 wherein said secondary feed means comprise injection means for forming a plurality of staged gas ports, each said staged gas port sized and positioned to form said secondary combustion zone as a secondary flame envelope peripherally surrounding a primary flame envelope of said primary combustion zone.

5. A burner apparatus according to claim 4 wherein each said staged gas port is directed radially inward at an injection angle of approximately 0° to approximately 30°.

6. A burner apparatus according to claim 4 wherein said recirculation means comprise at least one flue gas inlet in communication with said oxidant within said primary feed means.

7. A burner apparatus according to claim 6 wherein each said flue gas inlet comprises an inlet tube directed radially inward toward said primary combustion zone.

8. A burner apparatus according to claim 6 further comprising bypass means for bypassing at least a portion of said fuel/oxidant mixture and flue gas recirculated from said secondary combustion zone to said secondary feed means.

9. A burner apparatus according to claim 8 wherein said bypass means comprise said blower housing having an opening in communication with said primary feed means and said secondary feed means.

10. A burner apparatus according to claim 1 wherein said secondary feed means comprise injection means for forming a plurality of staged gas ports, each said staged gas port sized and positioned to form said secondary combustion zone as a secondary flame envelope peripherally surrounding a primary flame envelope of said primary combustion zone.

11. A burner apparatus according to claim 10 wherein each said staged gas port is directed radially inward at an injection angle of approximately 0° to approximately 30°.

12. A burner apparatus according to claim 1 wherein said recirculation means comprise at least one flue gas inlet in communication with said primary feed means.

13. A burner apparatus according to claim 1 wherein said bypass means comprise said blower housing having an opening in communication between said primary feed means and said secondary feed means.

14. A burner apparatus according to claim 1 wherein said primary feed means comprise a gas manifold mounted within a stream of said oxidant, and said gas manifold having a plurality of ports in communication with said gas manifold and said stream of said oxidant.

* * * * *